US005816941A

United States Patent [19]

Hayashi et al.

[11] Patent Number: 5,816,941

[45] Date of Patent: Oct. 6, 1998

[54] WOUND GOLF BALL

[75] Inventors: Junji Hayashi; Hisashi Yamagishi, both of Chichibu, Japan

[73] Assignee: Bridgestone Sports Co., Ltd., Tokyo, Japan

[21] Appl. No.: 831,516

[22] Filed: Apr. 1, 1997

[30] Foreign Application Priority Data

Apr. 3, 1996 [JP] Japan ..... 8-106313

[51] Int. Cl.[6] ..... A63B 37/06; A63B 37/12

[52] U.S. Cl. ..... 473/359; 473/363; 473/365; 473/377

[58] Field of Search ..... 473/363, 378, 473/359, 365, 377

[56] References Cited

U.S. PATENT DOCUMENTS 5,542,663 8/1996 Kato et al. ..... 473/363

5,674,137 10/1997 Maruko et al. ..... 473/378 X 5,688,191 11/1997 Cavallaro et al. ..... 473/378 X

*Primary Examiner*—George J. Marlo

*Attorney, Agent, or Firm*—Sughrue, Mion, Zinn, Macpeak & Seas, PLLC

[57] ABSTRACT

In a wound golf ball comprising a center ball having thread rubber wound thereon and a cover, the center ball consists of a center core having an outer diameter of 27–37 mm and a distortion of 3.5–10 mm under a load of 100 kg and an enclosure layer having a Shore D hardness of 55–68. The center ball has an outer diameter of 33–38 mm. The center core comprises a rubber composition having a base rubber, a co-cross linking agent and a peroxide and being free of an oily substance. The ball is improved in spin, control and flight distance at any head speed from high to low ranges so that players may favorably use it independent of their skill or head speed.

12 Claims, 1 Drawing Sheet

WOUND GOLF BALL

BACKGROUND OF THE INVENTION

1. Field of the Invention

This invention relates to a wound golf ball which is improved in spin, control, flight performance, and hitting feel so that even golf players with low club head speeds may favorably use it.

2. Prior Art

As compared with two- and multi-piece solid golf balls having a solid core enclosed with one or more covers, wound golf balls are superior in hitting feel and controllability, but inferior in flight distance upon driver shots because of an increased spin rate.

In order to increase the flight distance of wound golf balls upon driver shots, attempts were made to suppress spin as disclosed in JP-A 129072/1984 and JP-B 4104/1994. One exemplary wound golf ball has a center ball with a relatively large diameter.

The wound golf balls having a large diameter center ball are intended to increase the flight distance upon driver shots by suppressing the spin rate. However, since the center ball is relatively large, the hardness of the center ball has a substantial influence on ball performance. The hitting feel becomes hard or soft depending on whether the center ball is hard or soft. Additionally, a satisfactory flight distance is not always obtainable from the soft center ball since restitution is somewhat lost.

In addition, most of the above-mentioned proposals target golfers who swing at high club head speeds, that is, average to advanced players. Thus players who swing at high club head speeds can take advantage of these balls. However, when players who swing at low club head speeds, such as beginner, female and senior players use the same golf balls, they can not always obtain the advantage of increased flight distance. There is a need to solve these problems.

SUMMARY OF THE INVENTION

An object of the present invention is to provide a wound golf ball which is improved in spin, control, flight, and feel. Another object of the present invention is to provide a wound golf ball which even golf players with low head speeds can favorably use and which targets golf players of different skill encompassing from beginners to professionals.

In conjunction with a wound golf ball comprising a center ball having thread rubber wound thereon and a cover, the inventors have found that by constructing the center ball as a two-layer structure consisting essentially of a center core and an enclosure layer to a relatively large diameter, the ball is improved in control, flight and feel.

According to the invention, a relatively soft center core is formed to undergo a distortion of 3.5 to 10 mm under a constant load of 100 kg and to an outer diameter of up to 37 mm. A relatively hard enclosure layer is formed to have a Shore D hardness of at least 55. A center ball consisting of the center core and the enclosure layer is adjusted to a relatively large outer diameter of 33 to 38 mm. Then the relatively soft center core contributes to a soft hitting feel and serves to reduce spin and accordingly extend flight distance. The relatively hard enclosure layer improves the restitution of the ball. Since the center ball consisting of the center core and the enclosure layer is formed to have a relatively large diameter, spin susceptibility is further reduced so as to increase flight distance.

Examining if the performance of a golf ball constructed as above varies with club head speeds, the inventors have found that not only average to low-handicap players with relatively high swing speeds, but also those players with low swing speeds and hence, low club head speeds such as beginner, female, and senior players can equally take advantage of the ball. Differently stated, the wound golf ball of the above construction need not target only average to low-handicap players, but is adequate for all players of different levels of skill. The present invention is predicated on these findings.

Therefore, according to the present invention, there is provided a wound golf ball comprising a center ball, thread rubber wound thereon, and a cover, wherein said center ball consists essentially of a center core having an outer diameter of up to 37 mm and a distortion of 3.5 to 10 mm under a constant load of 100 kg and a layer enclosing the center core and having a Shore D hardness of at least 55, said center ball having an outer diameter of 33 to 38 mm.

BRIEF DESCRIPTION OF THE DRAWINGS

These and further features of the present invention will be apparent with reference to the following description and drawings.

The sole FIGURE.

DETAILED DESCRIPTION OF THE INVENTION

Figure 1:
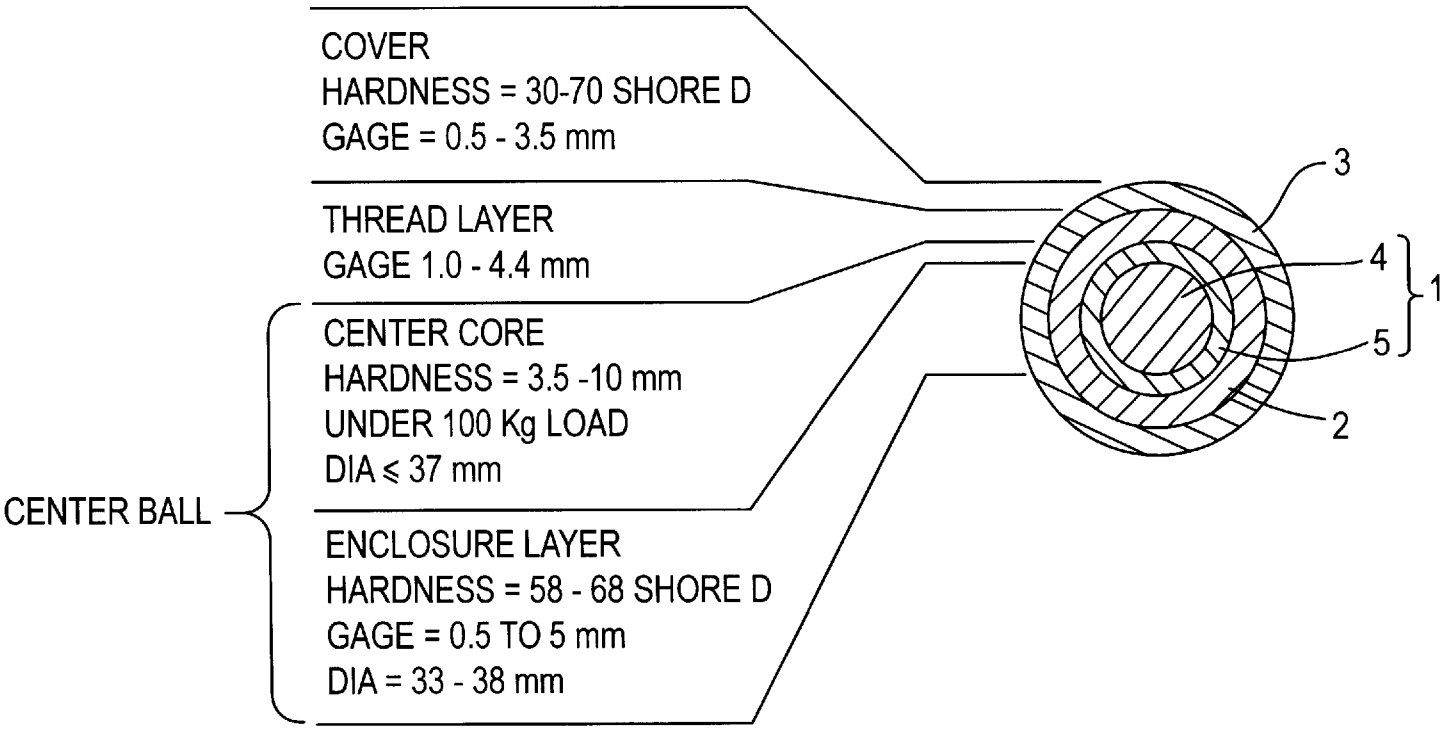
FIG. 1 is a cross-sectional view of a wound golf ball according to one embodiment of the invention.

The wound golf ball of the invention is shown in FIG. 1 as comprising a center ball 1, a thread rubber layer 2 formed by winding thread rubber around the center ball 1, and a cover 3 encasing the thread rubber layer 2. According to the invention, the center ball 1 is of a two-layer structure consisting essentially of a center core 4 and an enclosure layer 5 surrounding the core 4.

In order to provide a soft hitting feel, a controlled spin rate enough to increase a flight distance, and good rebound in a low head speed range, the center core 4 constituting the center ball 1 is formed relatively soft so that its distortion is 3.5 to 10 mm, preferably 4.5 to 9 mm under a fixed load of 100 kg, and to an outer diameter of up to 37 mm, preferably 27 to 36 mm. A center core distortion in excess of 10 mm under a load of 100 kg results in too soft hitting feel and a loss of restitution. With a distortion of less than 3.5 mm, the resultant hitting feel is hard and unpleasant, and the rebound in a low club head speed range is lost. An outer diameter in excess of 37 mm inevitably requires the thread rubber layer 2 be thin with a resultant loss of resilience.

The center core can be produced by a well-known method, for example, by heat compression molding of a conventional rubber composition comprising base rubber, a co-crosslinking agent, and a peroxide. The base rubber used herein may be polybutadiene rubber or a mixture of polybutadiene rubber and polyisoprene rubber as used in conventional solid centers although 1,4-polybutadiene having at least 90% of cis-structure is preferred, especially for high restitution.

The co-crosslinking agent which can be used herein include zinc and magnesium salts of unsaturated fatty acids such as acrylic acid and methacrylic acid and ester compounds such as trimethylpropane trimethacrylate as used in the prior art. Zinc acrylate is preferred because high resilience is expectable. The amount of the co-crosslinking agent blended is preferably 10 to 30 parts by weight per 100 parts by weight of the base rubber. Various peroxides are useful although dicumyl peroxide or a mixture of dicumyl peroxide and 1,1-bis(t-butylperoxy)-3,3,5-trimethylcyclohexane are preferred. The amount of the peroxide blended is preferably 0.5 to 1.5 parts by weight per 100 parts by weight of the base rubber.

If desired, zinc oxide or barium sulfate may be blended in the rubber composition for adjusting the specific gravity. Blending of other additives such as anti-oxidants is acceptable. Since a center core is generally frozen in order to prevent the center core from deforming upon winding of thread rubber, oily substance is often added to the center core for facilitating freezing. The oily substance added, however, can reduce restitution and adversely affect the temperature dependency of restitution. In the practice of the invention, it is thus recommended to omit such oily substance.

The center ball 1 of the wound golf ball according to the invention is constructed by surrounding the center core 4 with the enclosure layer 5.

The enclosure layer 5 is formed on the spherical surface of the center core having a relatively low hardness. The enclosure layer 5 is a relatively hard layer having a Shore D hardness of at least 55, preferably 58 to 68. It serves to impart rebound to the golf ball without altering the hitting feel and spin performance provided by the center core. If the Shore D hardness of the enclosure layer is less than 55, the center ball as a whole becomes too soft, with a restitution decline. The gage of the enclosure layer 5 is generally 0.5 to 5 mm, especially 1 to 3 mm although it may be appropriately selected in accordance with the hardness of the enclosure layer itself and the outer diameter of the center core 4. An enclosure layer having a gage of more than 5 mm naturally requires the center core to be reduced in diameter, with a possibility of losing soft feel and less spin. An enclosure layer having a gage of less than 0.5 mm would not exert its own function and can reduce restitution.

The enclosure layer 5 may be formed by injection molding a well-known thermoplastic resin around the center core 4. Any thermoplastic resin may be used insofar as it cures into a layer having a hardness in the above-defined range. For example, ionomer resins, polyester elastomers, and polyamide elastomers are preferably used. Illustrative examples include ionomer resins such as Himilan 1605, 1706, AM7317, 1601, 1557, and 1855 (trade name, manufactured by Mitsui-duPont Polychemical K.K.) and Surlyn 8940, 9910, 8527, and 9020 (trade name, manufactured by E. I. duPont), polyester elastomers such as Hytrel 5557 and 6347 (trade name, manufactured by Toray-duPont K.K.), and polyamide elastomers such as Pebax 5533 and 6312 (trade name, manufactured by Toray K.K.). Particularly when the cover is formed by heat pressure molding which will be described later, the heat can cause the enclosure layer to be melted to lose resilience. It is then recommended for the enclosure layer to use a resin having a higher melting point than the heating temperature.

The center ball 1 having the center core 4 enclosed with the enclosure layer 5 should have an outer diameter of 33 to 38 mm, preferably 34 to 37 mm in order to appropriately reduce a spin rate to increase a flight distance. A center ball having an outer diameter of more than 38 mm naturally requires the resilient thread rubber layer 2 to be thin, inviting a reduction of flight distance. A center ball having an outer diameter of less than 33 mm is ineffective for reducing spin susceptibility, failing to prevent sharp rise and flight shortage.

Next, the cover 3 of the wound golf ball according to the present invention may be produced using a well-known cover stock, for example, a resin composition comprising a base such as ionomer resins, polyurethane elastomers and balata rubber and conventional amounts of additives including pigments such as titanium white and dispersants such as magnesium stearate.

Although the hardness of the cover 3 is not particularly limited, it preferably has a Shore D hardness of 30 to 70, more preferably 35 to 65. Examples of the cover stock include ionomer resins such as Himilan (trade name, manufactured by Mitsui-duPont Polychemical K.K.) and Surlyn (trade name, manufactured by E. I. duPont), polyurethane elastomers such as Pandex (trade name, manufactured by Dai-Nihon Ink Chemical Industry K.K.), and balata rubber. Although the gage of the cover 3 is not particularly limited, it is preferably 0.5 to 3.5 mm, especially 1 to 3 mm. The cover 3 may be a single layer or a multilayer structure of two or more layers.

It is now briefly described how to prepare the golf ball of the present invention basically comprising the center ball 1, the thread rubber layer 2, and the cover 3. When thread rubber is wound around the center ball 1 to form the thread rubber layer 2 thereon to construct a wound core, thread rubber of a known type and a well-known winding method may be used. The thread rubber layer 2 preferably has a gage of 1 to 4.4 mm, especially 1.5 to 4 mm. The wound core composed of the center ball 1 and the thread rubber layer 2 is then enclosed with the cover 3 by well-known processes, for example, by directly injection molding the cover stock on the wound core. Alternatively, the cover may be applied by preforming a pair of hemispherical half cups from the cover stock, encasing the wound core in the half cups, and effecting heat pressure molding at 110° to 160° C. for 2 to 10 minutes. If desired, a cover of two or more layers may be formed by repeating the above-mentioned injection molding process or superposing and lapping two or more pairs of preformed half cups around the wound core followed by heat pressure molding.

The wound golf ball of the invention may be formed in its cover surface with dimples in a conventional pattern by a well-known method. The ball should have a diameter of not less than 42.67 mm and a weight of not greater than 45.93 grams in accordance with the Rules of Golf.

EXAMPLE

Examples of the present invention are given below together with Comparative Examples by way of illustration and not by way of limitation.

Examples 1–5 and Comparative Examples 1–3

A center ball was prepared by milling a rubber composition of the formulation shown in Table 1 in a roll mill and pressure molding it at 155° C. for 15 minutes to form a center core. An ionomer resin as shown in Table 1 was then injection molded around the center core to form an enclosure layer on the surface of the center core, completing the center ball.

Thread rubber was wound around the center ball by a conventional winding method to produce a wound core having an outer diameter of about 39.7 mm.

A cover stock was prepared by milling 100 parts by weight of an ionomer resin, 5 parts by weight of titanium white, and 0.3 part by weight of magnesium stearate in a twin-screw extruder. All Examples and Comparative Examples used the same ionomer resin in the form of a mixture of Himilan 1601 and 1557 in a weight ratio of 50/50

(manufactured by Mitsui-duPont Polychemical K.K.). Half cups were formed from the cover stock by injection molding.

The wound core was then encased in a pair of half cups which were subject to compression molding to form a cover, obtaining a wound golf ball.

The thus produced golf balls were examined for flight, hitting feel, and impact force.

The balls were actually hit with a driver (#W1) at a club head speed of 45 m/sec. and 35 m/sec. to measure a spin rate, carry, total distance, and angle of elevation.

The balls were also examined for hitting feel by a panel of three professional golfers with a head speed of about 45 m/sec. and three top class amateur women golfers with a club head speed of about 35 m/sec. who actually hit the balls. The ball was rated "◎" for very soft feel, "O" for soft feel, "Δ" for rather hard feel, and "X" for hard feel.

When the ball was hit with a driver at a club head speed of 45 m/sec., the impact force was measured by an accelerometer attached to the driver head at its back. Relative impact forces are expressed based on an impact force of 100 for Comparative Example 3.

The results are shown in Table 2.

It is evident from the results in Table 2 that wound golf balls within the scope of the present invention provided excellent spin performance, flight distance and hitting feel independent of head speeds. In contrast, a wound golf ball having a large diameter center of a relatively high hardness without an enclosure layer (Comparative Example 1) gave hard hitting feel due to its high hardness, received an increased spin rate, and traveled a somewhat shorter distance especially at a low head speed. Spin suppression was insufficient and the hitting feel was poor. A wound golf ball having a large diameter center of a relatively low hardness (Comparative Example 2) was acknowledged to have controlled spin and improved hitting feel although it traveled only a short distance due to the lack of restitution. A wound golf ball having a solid core of a conventional diameter and a cover (Comparative Example 3) received a high spin rate, with a resultant short distance, because of the thick thread rubber layer.

There has been described a wound golf ball which provides satisfactory spin, control and flight distance at any head speed from high to low head speed ranges. It is believed that a greater number of players will favorably use the ball regardless of their skill, that is, independent of their head speed.

TABLE 1

| | | E1 | E2 | E3 | E4 | E5 | CE1 | CE2 | CE3 |
|---|---|---|---|---|---|---|---|---|---|
| Core | Cis-1,4-polybutadiene | 100 | 100 | 100 | 100 | 100 | 100 | 100 | 100 |
| | Zinc acrylate | 20 | 22 | 18 | 25 | 11 | 32.5 | 18 | 11.5 |
| | Dicumyl peroxide | 1.2 | 1.2 | 1.2 | 1.2 | 1.2 | 1.2 | 1.2 | 1.2 |
| | Antioxidant | 0.2 | 0.2 | 0.2 | 0.2 | 0.2 | 0.2 | 0.2 | 0.2 |
| | Zinc oxide | 5 | 5 | 5 | 5 | 5 | 5 | 5 | 5 |
| | Barium sulfate | 61.7 | 61.1 | 62.2 | 33.0 | 123.5 | 34.0 | 39.4 | 105.3 |
| Enclosure layer | Himilan 1605 | 50 | 50 | — | 50 | — | | | |
| | Himilan 1706 | 50 | — | — | 50 | — | | | |
| | Himilan AM7317 | — | — | 50 | — | — | | | |
| | Himilan AM7318 | — | — | 50 | — | — | | | |
| | Himilan 1601 | — | — | — | — | 50 | | | |
| | Himilan 1557 | — | — | — | — | 50 | | | |
| | Himilan 1855 | — | 50 | — | — | — | | | |

TABLE 2

| | | E1 | E2 | E3 | E4 | E5 | CE1 | CE2 | CE3 |
|---|---|---|---|---|---|---|---|---|---|
| Center construction | | 2 layers | 2 layers | 2 layers | 2 layers | 2 layers | 1 layer | 1 layer | 1 layer |
| Core | diameter (mm) | 31.9 | 31.9 | 31.9 | 35.5 | 27.0 | 36.0 | 36.0 | 27.6 |
| | hardness*1 (mm) | 5.5 | 5.0 | 6.0 | 4.5 | 9.0 | 3.0 | 6.0 | 8.3 |
| Enclosure layer hardness (Shore D) | | 65 | 58 | 68 | 65 | 62 | — | — | — |
| Center diameter (mm) | | 35.9 | 35.9 | 35.9 | 37.9 | 33.2 | — | — | — |
| #W1 | Spin (rpm) | 2650 | 2680 | 2620 | 2660 | 2600 | 2780 | 2350 | 2920 |
| HS = 45 | Carry (m) | 211.0 | 210.8 | 211.3 | 211.0 | 210.0 | 209.3 | 205.3 | 207.4 |
| m/s | Total distance (m) | 225.7 | 225.2 | 226.1 | 225.6 | 225.0 | 224.8 | 220.6 | 222.5 |
| | Elevation angle (°) | 11.8 | 11.8 | 11.9 | 11.7 | 12.0 | 11.7 | 12.1 | 11.6 |
| | Hitting feel | ◎ | ◎ | ◎ | ◎ | ◎ | X | ◎ | ○ |
| #W1 | Spin (rpm) | 4100 | 4180 | 4010 | 4150 | 4040 | 4280 | 3870 | 4410 |
| HS = 35 | Carry (m) | 143.6 | 143.3 | 144.1 | 143.4 | 143.1 | 141.8 | 140.1 | 141.2 |
| m/s | Total distance (m) | 155.4 | 155.1 | 155.9 | 155.4 | 155.1 | 153.0 | 150.7 | 152.2 |
| | Elevation angle (°) | 13.2 | 13.1 | 13.3 | 13.1 | 13.2 | 13.0 | 13.5 | 12.9 |
| | Hitting feel | ◎ | ◎ | ◎ | ◎ | ◎ | X | ◎ | Δ |
| Impact force | | 94 | 95 | 93 | 96 | 93 | 110 | 92 | 100 |

*1Core hardness is a distortion (mm) of the core under a load of 100 kg

Although some preferred embodiments have been described, many modifications and variations may be made thereto in the light of the above teachings. It is therefore to be understood that within the scope of the appended claims, the invention may be practiced otherwise than as specifically described.

We claim:

1. A wound golf ball comprising: a center ball, thread rubber wound thereon, and a cover, said center ball consists of a center core having an outer diameter of up to 37 mm and a distortion of 3.5 to 10 mm under a constant load of 100 kg and an enclosure layer enclosing the center core and having a Shore D hardness of at least 55, said center ball having an outer diameter of 33 to 38 mm, and wherein said center core comprising a rubber composition having a base rubber, a co-crosslinking agent and a peroxide and being free of an oily substance.

2. The wound golf ball of claim 1 wherein said enclosure layer has a gage of 0.5 to 5 mm.

3. The wound golf ball of claim 1 wherein said center core has a diameter in the range of 27 to 36 mm.

4. The wound golf ball of claim 1 wherein said center core has a distortion in the range of 4.5 to 9.0 mm under a constant load of 100 kg.

5. The wound golf ball of claim 1 wherein said enclosure layer is formed from a thermoplastic resin.

6. The wound golf ball of claim 1 wherein said enclosure layer has a gage in the range of 1.0 to 3.0 mm.

7. The wound golf ball of claim 1 wherein said enclosure layer has a Shore D hardness in the range of 58 to 68.

8. The wound golf ball of claim 1 wherein said thread rubber layer has a gage in the range of 1.0 to 4.4 mm.

9. The wound golf ball of claim 1 wherein said cover has a Shore D hardness in the range of 30 to 70.

10. The wound golf ball of claim 1 wherein said cover has a Shore D hardness in the range of 35 to 65.

11. The wound golf ball of claim 1 wherein said cover has a gage in the range of 0.5 to 3.5 mm.

12. The wound golf ball of claim 1 wherein said cover comprises at least one layer made from an ionomer resin.

* * * * *